US005803836A

United States Patent [19]

Beintema

[11] Patent Number: 5,803,836

[45] Date of Patent: Sep. 8, 1998

[54] HITTING PRACTICE DEVICE

[76] Inventor: John L. Beintema, 10531 Maryland Cir., Bloomington, Minn. 55438

[21] Appl. No.: 740,296

[22] Filed: Oct. 25, 1996

[51] Int. Cl.[6] ..... A63B 69/00

[52] U.S. Cl. ..... 473/429

[58] Field of Search ..... 473/429, 430

[56] References Cited

U.S. PATENT DOCUMENTS

| | | | |
|---|---|---|---|
| 2,976,040 | 3/1961 | Bales | 473/429 |
| 3,006,647 | 10/1961 | Haskett | 473/429 |
| 3,216,723 | 11/1965 | Galezniak | 473/429 |
| 4,793,612 | 12/1988 | Hammond | 473/429 |
| 5,000,450 | 3/1991 | Beintema | 473/429 |
| 5,511,625 | 4/1996 | Mork | 172/445.1 |

*Primary Examiner*—William H. Grieb
*Attorney, Agent, or Firm*—James W. Miller

[57] ABSTRACT

A device for practicing hitting a ball is disclosed. The device comprises a support arm. A ball is suspended from the support arm such that the ball swings generally vertically in a substantially upright plane of rotation when the ball is struck substantially squarely. A selectively adjustable mechanism provides for a plurality of different, substantially upright rotational planes in which the ball can swing on the support arm when the ball is struck squarely, to thereby permit practice of different hitting skills depending upon which vertical rotational plane has been selected.

15 Claims, 4 Drawing Sheets

HITTING PRACTICE DEVICE

TECHNICAL FIELD

The present invention relates to a device for teaching and practicing hitting skills used in baseball, softball or any other sports which require hitting a ball.

BACKGROUND OF THE INVENTION

Certain sports require the player to hit or strike a moving ball. Baseball and softball are the best known sports of this type. The batter is required to hit a pitched ball with an elongated bat. However, certain other sports, such as tennis or badminton, have similar skill requirements, i.e. a moving ball is struck by a racquet rather than a bat.

Various hitting practice devices comprise elongated support arms attached to poles which suspend a ball from the arm in a tether type fashion. Such devices are shown in U.S. Pat. No. 2,976,040 to Bales and U.S. Pat. No. 4,793,612 to Hammond. The Applicant's own prior U.S. Pat. No. 5,000,450 shows another hitting practice device of this type, but having an improved fastening means for securing the support arm to the post in a cantilever manner. Thus, the Applicant's previously known device is much easier and quicker to install than previously known devices of the type shown in Bales and Hammond.

An improved ball suspension means was also shown in the Applicant's prior patent for use with the support arm. The ball suspension means comprises an elongated cord having one end secured to the ball. An eyelet is located at the other end of the cord. An outwardly extending stud forming a horizontal pivot is located at a free end of the support arm. The stud has a smooth cylindrical bearing surface with the eyelet suited to be received on the bearing surface for rotation of the ball and cord in a vertical plane therearound.

Because the stud was rigidly fixed to the support arm in a single position, namely a position in which the stud member was aligned with the axis of the support arm, the ball and cord rotate in only one vertical plane relative to the support arm. This plane is normal or perpendicular to the axis of the support arm. While this is optimum for teaching or practicing straight away hitting of the ball, it is not optimum for teaching or practicing pull or slice hitting, i.e. hitting skills needed to hit pitches down the left or right field lines in baseball or softball.

SUMMARY OF THE INVENTION

Accordingly, one aspect of this invention is to provide a hitting practice device which can be quickly and easily adjusted to allow the ball to rotate in different vertical planes relative to the support arm.

One aspect of this invention relates to a device for practicing hitting a ball. The device comprises a support arm. A means is provided for suspending a ball from the support arm such that the ball swings generally vertically on the support arm in a substantially upright plane of rotation when the ball is struck substantially squarely. Finally, a selectively adjustable means is provided for providing a plurality of different, substantially upright rotational planes in which the ball can swing on the support arm when the ball is struck squarely, thereby to be able to practice different hitting skills depending upon which vertical rotational plane has been selected.

BRIEF DESCRIPTION OF THE DRAWINGS

The present invention will be described hereafter in the Detailed Description, taken in conjunction with the following drawings, in which like reference numerals refer to like elements or parts throughout.

DETAILED DESCRIPTION

Figure 1:
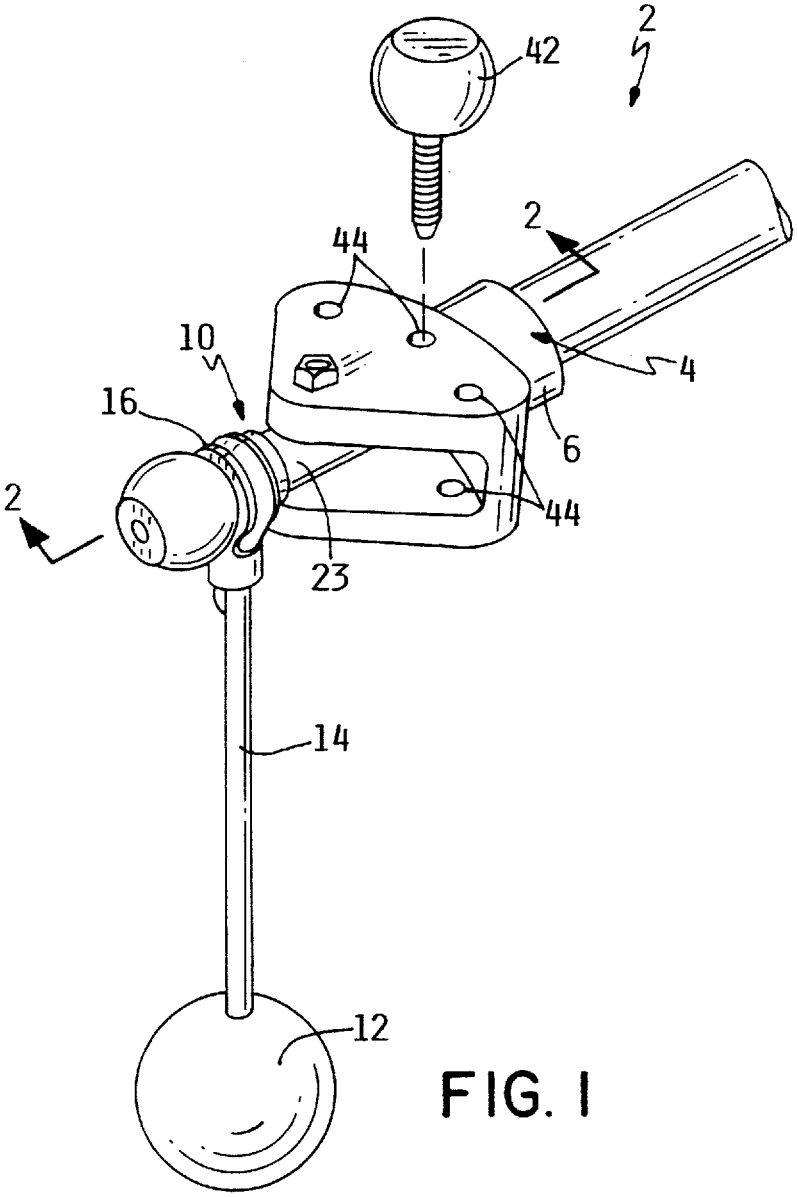
FIG. 1 is a perspective view of an improved hitting practice device according to the present invention with the support arm having been cut away to shorten the length of the support arm as depicted in FIG. 1, particularly illustrating the adjustable mounting of the ball suspension means on the support arm.
Figure 2:
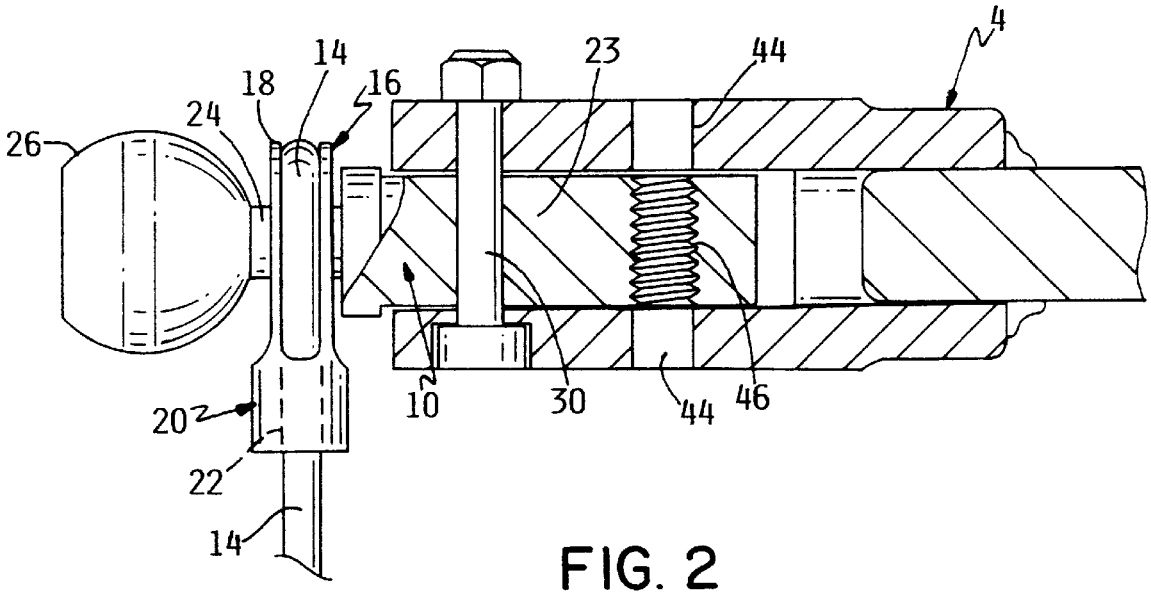
FIG. 2 is a cross-sectional view of the hitting practice device shown in FIG. 1, taken along lines 2—2 in FIG. 1.

The hitting practice device of this invention, illustrated generally as 2 in FIGS. 1 and 2, is used to teach and/or practice hitting a ball, e.g. for practicing hitting a baseball or softball with a bat, a tennis ball with a tennis racquet, etc. Practice device 2 comprises a support member 4 that extends substantially horizontally a few feet above the ground. Support member 4 is preferably an elongated arm fastened in a cantilevered manner to an existing fence post or other similar pole (not shown). Only the free, unsupported end 6 of support member 4 is shown in the drawings. The other end of support member 4 having the support member fastening means is broken away and is not specifically illustrated in the drawings.

Any suitable means for fastening support member 4 to a post or pole or fence could be used. For example, the chain type fastening means shown in the Applicant'sprior U.S. Pat. No. 5,000,450, which patent is hereby incorporated by reference, could be used on the non-illustrated end of support member 4. The precise nature and type of the support member fastening means is not important to this invention, which is why it has not been illustrated in the drawings. All that is important is that some mounting means be provided for allowing support member 4 to extend above the ground and be relatively rigid and non-movable during use.

A means 10 is provided for suspending a ball on free end 6 of support member 4 with the ball hanging below support member 4 to serve as a target during the hitting practice. Ball suspension means 10 comprises a ball 12 which is attached to a flexible connecting member such as a rope or cord 14. Ball 12 can be drilled to allow cord 14 to pass through ball 12. A knot (not shown) on the lower end of cord 14 retains ball 12 on cord 14. A washer (not shown) could be placed if desired between this knot and ball 12.

The other end of cord 14 is secured to a pear shaped metallic eyelet 16 having a circular hole in the body thereof and a peripheral groove 18 extending around the sides thereof. A hollow clasp 20 is formed as the lower part of eyelet 16 and has a cylindrical clasp passage 22 located generally beneath groove 18. Cord 14 passes upwardly from ball 12 through a first side of clasp passage 22 in clasp 20, is inserted in groove 18 around eyelet 16, and then passes back downwardly through the other side of clasp passage 22 in clasp 20. An enlarged knot (not shown) is then placed on the end of cord 14 beneath clasp 20 to hold ball 12, cord 14, and eyelet 16 together as an assembled unit.

Ball suspension means 10 further includes a stem 23 that has a smooth, reduced diameter cylindrical bearing portion 24 and an outer threaded end. Eyelet 16 can be slipped onto bearing portion 24 with the width of eyelet 16 being somewhat less than the width of bearing portion 24. Then, a threaded knob 26 is hand tightened onto the outer threaded end of stem 23 to hold the ball and cord unit in place on stem 23.

Various types of balls could be used on cord 14 depending on the sport which it is desired to practice, e.g. a baseball, a softball, a tennis ball, etc. In fact, it is preferred that various cord and ball units be pre-assembled so that a change from one type of ball to another may be quickly and easily accomplished.

Stem 23 and specifically bearing portion 24 forms a horizontal pivot on which the ball and cord unit is rotatably mounted. Thus, when ball 12 is struck, ball 12, cord 14, and eyelet 16 all swing together in a substantially vertical plane about the axis of stem 23. When a baseball or softball is struck squarely by a bat, this rotation is smoothly contained within the vertical plane. If the baseball or softball is struck improperly, then the rotation is wobbly and may pass in and out of the vertical plane. Thus, the user knows how well ball 12 was struck by the smoothness of the path of ball 12 within the vertical rotational plane, the object being to get ball 12 to rotate smoothly in the plane without wobbling back and forth.

While using a rotatable eyelet 16 on the outer diameter of a horizontal bearing portion 24 of stem 23 is one convenient way of attaching ball 12 to support member 4, other types of attachments could be used. For example, bearing portion 24 itself could be rotatably carried on ball suspension means 10 in some type of bearing within stem 23 with cord 14 simply passing through a hole in the bearing portion 24 before being knotted. Thus, this invention is not limited to a particular type of ball suspension means 10 for suspending ball 12 from support member 4.

An important feature of this invention involves an adjustable mounting of ball suspension means 10 to support member 4 to allow the vertical plane of rotation of ball 12 to be varied relative to support member 4. Ball suspension means 10 is adjustably carried on end 6 of support member 4 to allow stem 23 to be swung in a horizontal plane between various adjusted positions. Preferably, ball suspension means 10 has stem 23 pivotally journalled on a vertical pivot pin 30 carried on support member 4 to accomplish the desired adjustments.

In known batting practice devices of this general type, such as that shown in the Applicant's prior U.S. patent incorporated by reference, the ball suspension means 10 is integrally fixed to the end 6 of support member 4 such that a single vertical rotational plane is provided that is perpendicular to end 6 of support member 4. While this is fine for learning and practicing straight away hitting of the type needed to hit a pitch that is thrown over the middle of the plate, it does not allow the user to as effectively practice hitting inside or outside pitches. For such additional practice to be effective, some means must be provided to allow ball 12 to travel in different rotational planes, i.e. planes other than the one that is strictly perpendicular to support member 4.

The pivotal mounting of ball suspension means 10 on end 6 of support member 4 allows the necessary adjustments to be provided. In the normal straight away position shown in FIG. 3, stem 23 is aligned with support member 4. However, ball suspension means 10 can be selectively pivoted in one direction about pivot pin 30 to place stem 23 at a positive angle relative to support member 4 (See FIG. 4), or pivoted in the opposite direction about pivot pin 30 to place stem 23 at a negative angle relative to support member 4 (See FIG. 5). Thus, practice device 2 preferably has three adjusted positions for stem 23 as shown in FIGS. 3–5.

In each adjusted position of ball suspension means 10, i.e. in either the normal position in which stem 23 is aligned with support member 4 or the forwardly or negatively angled positions, a means 40 is provided for locking ball suspension means 10 in place. Locking means 40 comprises a vertical locking pin 42 that passes downwardly through aligned holes 44 provided in support member 4 and through a locking hole 46 provided in stem 23 of ball suspension means 10. This locking pin 42 must be removed by unthreading it from locking hole 46 to allow the adjustment of stem 23 to take place. Locking pin 42 has an enlarged head to allow the user to manipulate pin 42 for removal and/or insertion.

Figure 3:
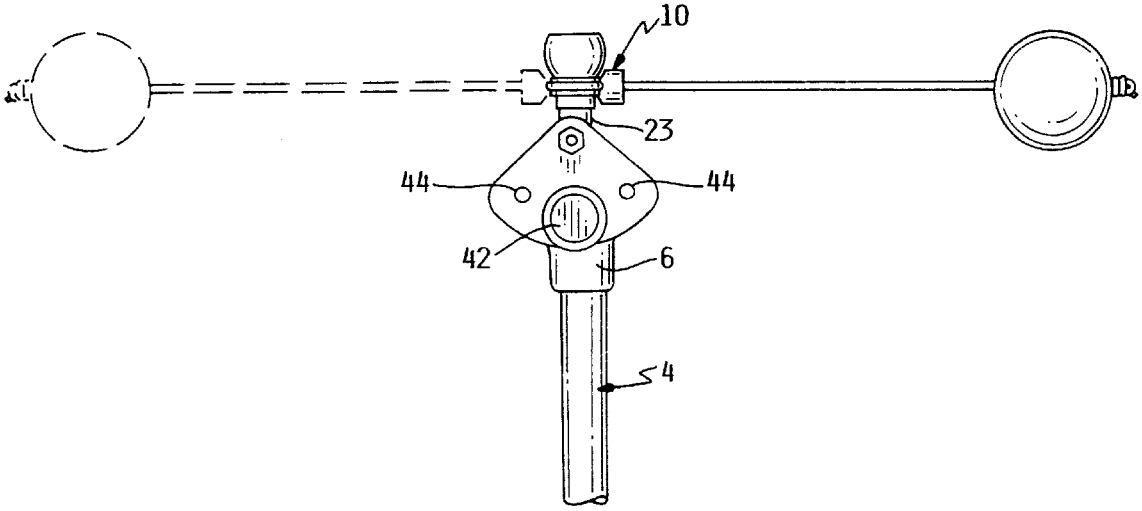
FIG. 3 is a top plan view of the hitting practice device shown in FIG. 1, particularly illustrating the ball suspension means in a first adjusted position on the support arm for use in teaching or practicing straight away hitting.
Figure 4:
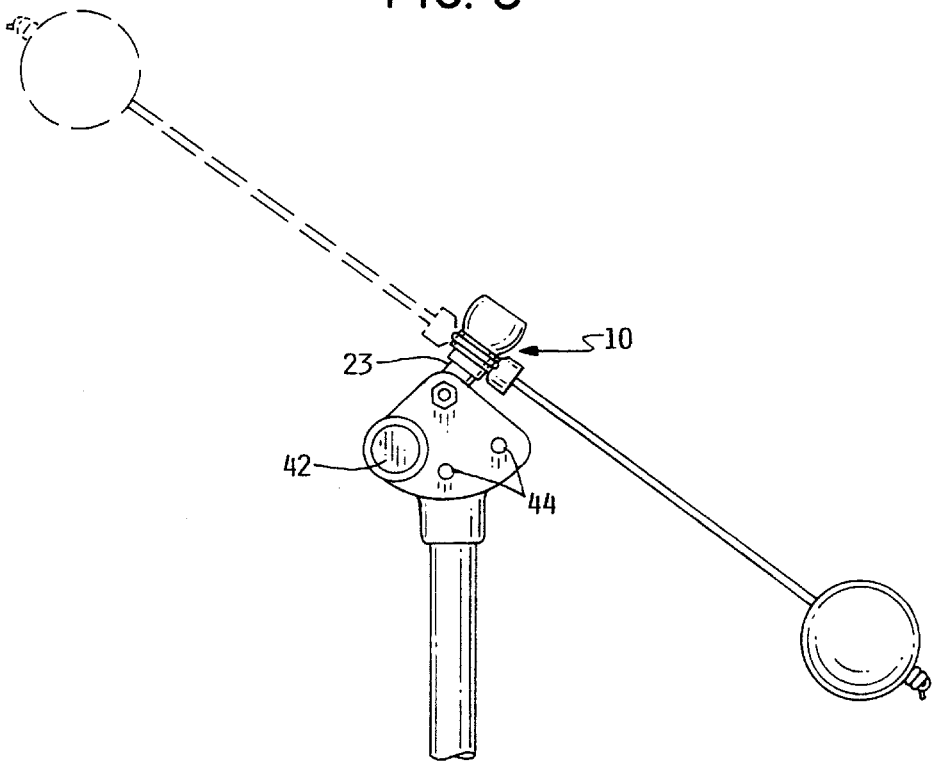
FIG. 4 is a top plan view of the hitting practice device shown in FIG. 1, particularly illustrating the ball suspension means in a second adjusted position on the support arm for use in teaching or practicing slice hitting.
Figure 5:
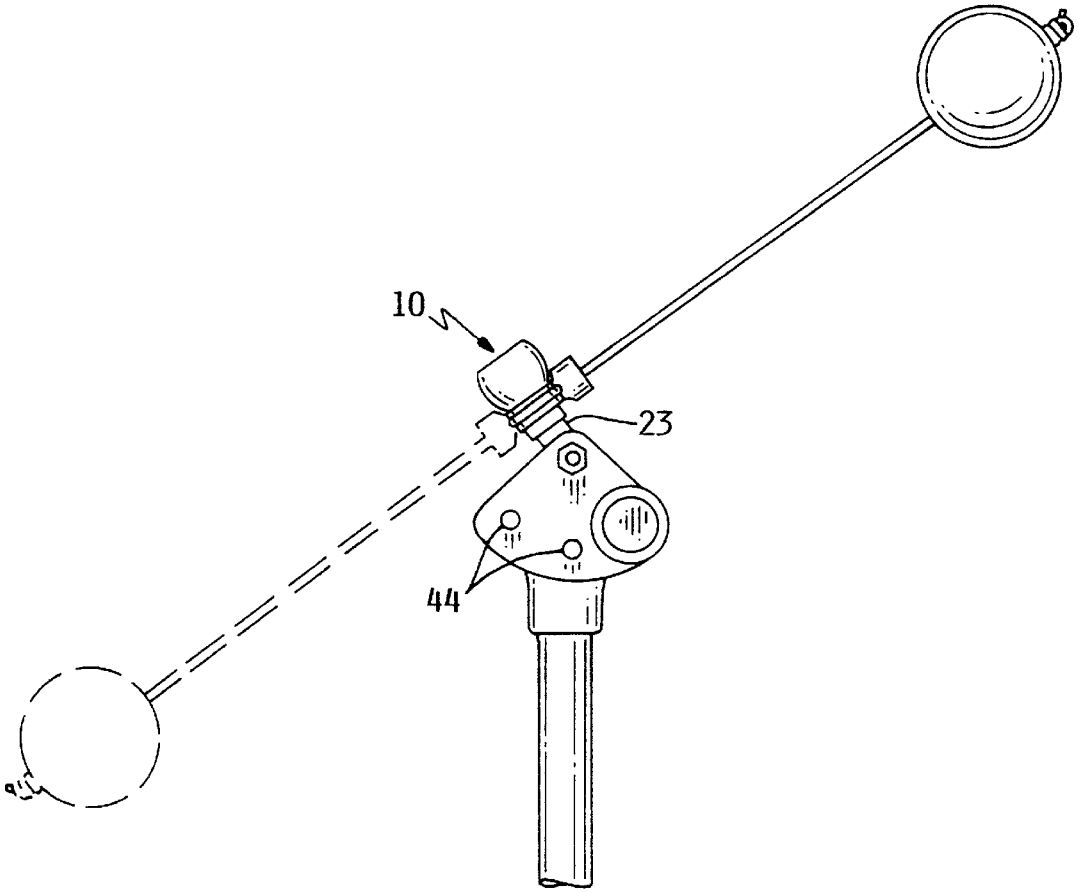
FIG. 5 is a top plan view of the hitting practice device shown in FIG. 1, particularly illustrating the ball suspension means in a third adjusted position on the support arm for use in teaching or practicing pull hitting.

Referring now to FIGS. 3–5, the operation of practice device 2 of this invention will be described. Normally, if one wishes to practice straight away hitting, e.g. to practice a swing of the type needed to hit a baseball or softball that would be thrown in the middle of the plate, ball suspension means 10 would be adjusted as shown in FIG. 3. In this position, stem 23 is aligned with support member 4. A right handed batter would then stand a suitable distance to one side of support member facing ball suspension means 10 and will swing the bat at ball 12 as ball 12 hangs below support member 4.

When ball 12 is struck squarely, ball 12 will smoothly rotate in a first substantially vertical plane that is perpendicular to end 6 of support member 4. This plane is illustrated in FIG. 3 by the solid and phantom line illustrations of ball 12, cord 14 and eyelet 16 which show the general orientation of the plane. Note that this plane is perpendicular to support member 4 in FIG. 3. The solid line illustration of ball 12 in FIG. 3 (and in FIGS. 4 and 5) is after the ball has been struck and has swung around about 90° and does not represent the position of the ball before it has been hit. The user can practice hitting ball 12 until smooth rotation of the ball 12 is achieved in this plane.

However, assume that the user wishes to practice hitting an inside pitch. For a right handed batter, a pitch over the inside of the plate might desirably be pulled down the left field line. This takes a different stance and/or swing than that used to hit straight away a pitch thrown down the center of the plate. Practice device 2 of this invention allows the user to practice the stance and/or swing required to pull a pitch down the left field line.

For a right handed batter to practice pull hitting, locking pin 42 would be removed to allow ball suspension means 10 to be pivoted until it is negatively angled relative to support member 4 as shown in FIG. 5. When ball suspension means 10 reaches the desired position and the holes 44 and 46 align, locking pin 42 is reinserted to retain ball suspension means 10 in this adjusted position. In this adjusted position, the horizontal pivot formed by stem 23 is angled negatively to support member 4 such that ball 12 will hang down slightly to the rear of support member 4.

If the user now attempts to strike ball 12, he or she needs to use a swing that will cause ball 12 to orbit smoothly around stem 23 in a new vertical rotational plane that is angled to support member 4. See the illustration of FIG. 5 for a depiction of the new vertical rotational plane in which the ball desirably travels. When the user finds and duplicates the swing that allows smooth rotation of ball 12 within this angled plane, he or she has discovered the swing that will allow the user to pull an actual pitch down the left field line. Duplicating this swing under actual game conditions against actual thrown pitches should help provide the desired result.

Similarly, considering an outside pitch, a right handed batter needs yet a different swing to punch or slice such a pitch down the right field line. Again, practice device 2 of this invention allows the user to discover and then practice this swing by adjusting ball suspension means 10 to its third adjusted position shown in FIG. 4. In this position, stem 23 is positively angled relative to support member 4 such that ball 12 will now travel in a third vertical rotational plane when struck with the kind of swing that will usually hit an outside pitch down the right field line. Thus, the user needs to practice swinging until ball 12 in FIG. 4 travels smoothly in the third vertical rotational plane that is shown in FIG. 4.

Practice device 2 of this invention is thus highly useful in teaching and practicing different types of hitting skills having different stances and/or swings. This result is achieved by the adjustable mounting of ball suspension means 10 relative to support member 4, which allows the vertical plane of rotation of ball 12 to be varied.

Support member 4 and stem 23 are not limited to a particular length or shape. It is preferred that stem 23 be relatively short and support member 4 be relatively long such that ball suspension means 10 is pivotally mounted to the outer, free end of an elongated arm type support member 4 as shown herein. However, the relative lengths of these parts could be reversed with stem 23 being relatively long and support member 4 being very short as long as stem 23 is still adjustably connected to support member 4 in some fashion to allow the rotational plane of the ball to be varied.

For example, support member 4 could comprise simply a very short, tubular, socket forming support member that is itself connected to the post or pole by some type of fastening means. In this case, stem 23 would comprise a long arm adjustably connected to such socket type support member. For example, stem 23 could be pivotally mounted in some fashion to the socket of the support member. Alternatively, the socket could be provided with different sets of socket apertures allowing stem 23 to be inserted into the socket in the required different orientations. In any event, such a setup of a short support member 4 and a long arm type stem 23 would still function and be covered by this invention as it still includes a separate, albeit short, support member that is supported in some fashion above the ground and a ball suspension means, now including a long elongated stem 23, adjustably connected to the support member to allow the plane of rotation of the ball to be varied.

Various modifications of this invention will be apparent to those skilled in the art. For example, a rack and pinion adjustment could be used to pivot ball suspension means 10 about a vertical axis and provide more than three adjusted positions, rather than the hand operated adjustment for providing three discrete positions as shown herein. Thus, the scope of this invention is to be limited only by the appended claims.

I claim:

1. A device for practicing hitting a ball, which comprises:

(a) a support member;

(b) means for suspending a ball from the support member such that the ball swings generally vertically on the support member in a substantially upright plane of rotation when the ball is struck substantially squarely; and (c) selectively adjustable means for providing a plurality of different, substantially upright rotational planes in which the ball can swing on the support member when the ball is struck squarely, thereby to be able to practice different hitting skills depending upon which rotational plane has been selected.

2. A hitting practice device, which comprises:

(a) a support member;

(b) means for permitting a ball to rotate in a first plane which is substantially perpendicular to the support member; and (c) means for adjusting the rotation permitting means on the support member to be able to adjust the rotational plane of the ball from the first plane to at least one other plane that is non-perpendicular to the support member.

3. A device as recited in claim 2, wherein the adjusting means has means to be able to adjust the rotational plane of the ball from the first plane to at least two other planes that are both non-perpendicular to the support member.

4. A device as recited in claim 3, wherein the rotation permitting means includes a horizontal pivot, and wherein the rotational planes are substantially vertical planes.

5. A device for practicing hitting a ball, which comprises:

(a) a support member;

(b) a substantially horizontal pivot carried by the support member;

(c) a ball connected to the pivot such that the ball swings in a substantially vertical rotational plane when struck during hitting practice; and (d) an adjustable connection on the support member to allow the orientation of the pivot relative to the support member to be varied to thereby selectively change the orientation of the rotational plane of the ball relative to the support member.

6. A device as recited in claim 5, wherein the adjustable connection is a pivotal connection.

7. A device as recited in claim 6, wherein the adjustable connection is between the pivot and the support member.

8. A device as recited in claim 7, wherein the pivot is carried on the support member for a pivoting adjustment about a substantially vertical pivot axis, whereby the horizontal pivot can be swung in a substantially horizontal plane relative to the support member to vary its orientation relative to the support member.

9. A device as recited in claim 5, wherein a plurality of discrete adjusted positions are provided by the adjustable connection, and further including means for locking the horizontal pivot in any one of the adjusted positions at a given time.

10. A device as recited in claim 5, wherein the support member comprises a substantially horizontal support member.

11. A device as recited in claim 10, wherein the pivot is provided on an outer end of the support member.

12. A device as recited in claim 11, wherein the pivot is pivotally adjustable on an outer end of the support member for adjustment about a substantially vertical pivot axis carried on the outer end of the support member.

13. A device as recited in claim 5, wherein the ball is connected to the pivot by an elongated connecting member.

14. A device as recited in claim 13, wherein the connecting member comprises a flexible rope or cord.

15. A device as recited in claim 14, wherein the rope or cord includes a metallic eyelet on one end for journalling the ball on the pivot for rotation about the pivot.

* * * * *